United States Patent [19]

Gregory

[11] 4,031,619

[45] June 28, 1977

[54] MANUAL, HYDRAULICALLY OPERATED TOOL

[76] Inventor: Jack T. Gregory, 390 Redwood Road, San Anselmo, Calif. 94960

[22] Filed: Jan. 19, 1976

[21] Appl. No.: 650,559

[52] U.S. Cl. ..... 30/180; 81/301; 60/477

[51] Int. Cl.[2] ..... B26B 17/00; B25B 7/22

[58] Field of Search ..... 60/477; 30/180, 190, 30/228; 254/93 H; 81/301

[56] References Cited

UNITED STATES PATENTS

| | | | |
|---|---|---|---|
| 492,931 | 3/1893 | Baird | 30/180 |
| 2,131,815 | 10/1938 | Nilson | 254/93 H |
| 2,714,250 | 8/1955 | Twedt | 30/180 |
| 2,791,028 | 5/1957 | Bidin | 30/180 |

*Primary Examiner*—James L. Jones, Jr.
*Assistant Examiner*—J. C. Peters
*Attorney, Agent, or Firm*—Limbach, Limbach & Sutton

[57] ABSTRACT

A hydraulically operated tool in which the working elements are operated by a ram and cylinder chamber assembly with the pumping unit for the tool being concentrically located within the ram and the hydraulic fluid reservoir being collapsible and contained in one of the tool handles.

19 Claims, 8 Drawing Figures

MANUAL, HYDRAULICALLY OPERATED TOOL

BACKGROUND OF THE INVENTION

This invention relates to manual, hydraulically operated tools designed for multiple purposes but primarily for cutting multi-strand cables, bars, and the like.

In the construction industry it is often necessary to provide convenient means for cutting materials such as cables, reinforcing bars, and the like. This has heretofore been done either by extremely long handled cutters which require two men to operate or by the use of relatively complex, expensive, hydraulically operated tools.

Manual, hydraulically operated tools of the prior art type are difficult to manufacture economically and are difficult to keep in proper maintenance because of their relative complexity. It is thus highly desirable to provide a simply manufactured and maintained manual, hydraulically operated tool. Moreover, it is also desirable to provide a hydraulic operating mechanism which can be easily adapted for a multitude of uses by the manufacturer without major substantive changes in the hydraulic system.

SUMMARY OF THE INVENTION

The above-described disadvantages of the prior art and the desirable features of economy and simplicity of operation and manufacture are achieved by the present invention of an improved manual, hydraulically operated tool of the type which has a cylinder chamber closed at one end and a hydraulic ram within the cylinder chamber operated by hydraulic pumping means fed from a fluid reservoir, with the ram and cylinder chamber being connected to work piece engaging elements which are moved by the differential action of the ram within the cylinder chamber. The improvement of the invention comprises mounting the pumping means within the ram. In a preferred embodiment of the invention the pumping means constitute a plunger in a bore which are both actually concentric within the ram and cylinder chamber, thereby balancing all of the axial forces. In the preferred embodimemt, the pumping means cause fluid from a collapsible fluid reservoir to be injected into the cylinder chamber at the closed end through fluid inlet and outlet passages which are actually in the ram itself.

The pumping means in the preferred embodiment include the pump bore within the ram with the bore having its major axis extending parallel to the directional movement of the ram, and the plunger having one end fitted within the pump bore. Check valve means mounted in the ram itself allow fluid to be inducted through fluid passages from the collapsible reservoir into the pump bore and then ejected by the action of the plunger within the pump bore into the space between the end of the ram and the closed end of the cylinder chamber.

In the preferred embodiment the pump plunger is operated by a pair of handles, one of which is attached to the cylinder chamber and the other of which is pivoted on the ram itself to operate the plunger by being moved towards the other handle by the operator. After the ram has been partially extended out of the cylinder chamber to operate the working elements, the system may be restored to its initial condition by manually operating a release valve which allows the accumulated fluid between the end of the ram and the closed end of the cylinder chamber to be fed back to the collapsible reservoir through a series of fluid passages.

By having a collapsible fluid reservoir, no air need enter the system and the unit can be completely self-contained. Moreover, by having the pumping means mounted within the ram, not only are the axial forces balanced but also a great economy of manufacture is achieved in that the pump chamber is simply a hollow bore within the ram itself. In the hydraulic system of the present invention, there are actually only four major moving parts plus the inlet and outlet check valves.

In a second preferred embodiment the hydraulic system is used in conjunction with a wedge shaped member to expand the opposite ends of a pair of pivoted cutting jaws so as to gain an even greater mechanical advantage.

The hydraulic system of the present invention is suitable for operating cutting jaws of the mesh and shear types, clamps, expanding elements for use in breaking forms loose, and a variety of other types of tools which require an enormous amount of force from a relatively light-weight and simple-to-operate tool.

It is therefore an object of the present invention to provide an improved, manual, hydraulically-operated tool using a minimum number of elements;

It is another object of the present invention to provide a manual, hydraulically operated tool in which the axial forces are aligned and balanced;

It is still another object of the present invention to provide a manual, hydraulically operated tool which is simple to maintain and operate;

It is still another object of the present invention to provide a relatively light-weight, manual, hydraulically operated tool.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 1:
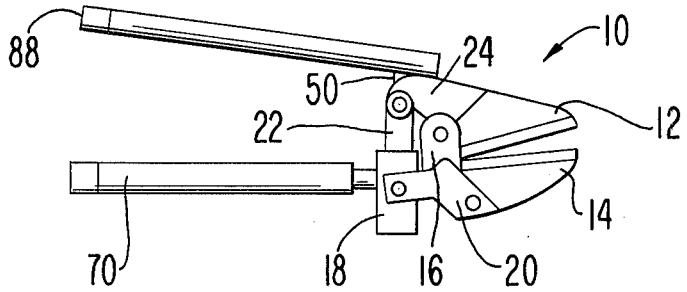
FIG. 1 is a side view in elevation of a manual, hydraulically-operated cutting tool according to one embodiment of the invention.
Figure 2:
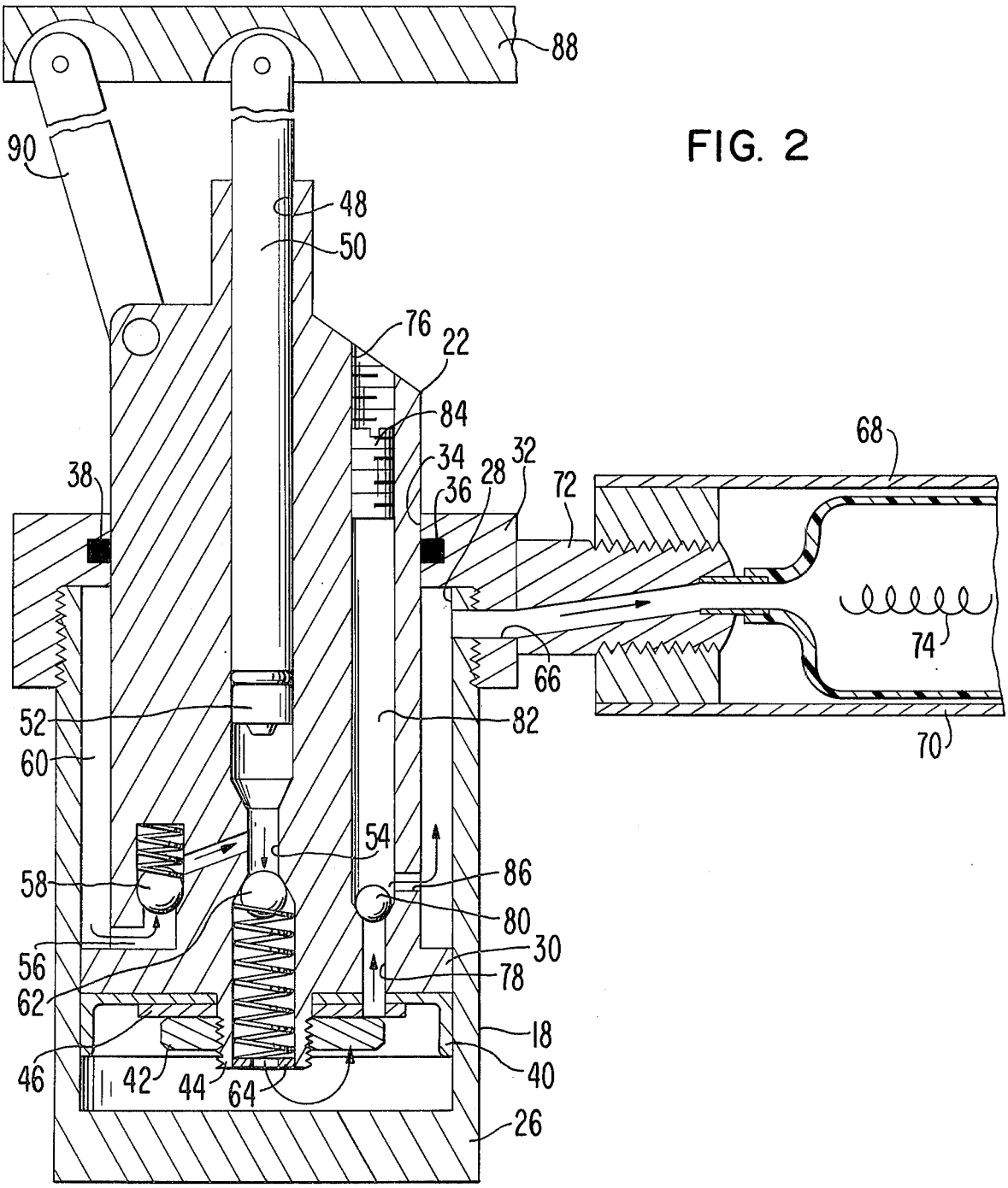
FIG. 2 is an enlarged, sectional view of the hydraulic system for operating the tool depicted in FIG. 1.

Referring more particularly to FIGS. 1 and 2, a manual, hydraulically operated cutter 10 according to the invention includes a pair of upper and lower cutting jaws 12 and 14, respectively, with the cutting jaws being linked together by a pivot link 16 at the end of the cutting jaws closest to the hydraulic assembly. The hydraulic assembly is comprised of a cylinder chamber 18 pivotally attached to a yoke frame 20 mounted on the lower jaw 14 and a ram 22 pivotally attached at its top end to a yoke 24 mounted on the rear end of the cutting jaw 12. It will be appreciated that since the cutting jaws 12 and 14 have the connecting pivot link 16 located between the cutting edges of the jaws and the hydraulic assembly, they are closed together upon expansion of the hydraulic assembly. That is, when ram 22 is caused to extend out of the cylinder chamber 18 to space apart the rear ends of the yoke members 24 and 20, the jaws 12 and 14 pivot about the connecting link 16 so as to close together.

The means by which the hydraulic assembly is operated is best shown in FIG. 2. The ram 22 is fitted concentrically within the cylinder chamber 18. Cylinder chamber 18 has a closed end 26 and an open end 28. The bottom edge of the ram 22, as viewed in FIG. 2, has a shoulder 30 whose outer diameter is only slightly less than the interior diameter of the hollow cylinder chamber 18. This shoulder 30 acts as the lower piston bearing. The top of the cylinder chamber is closed by a seal and bearing housing 32 which is threaded onto the open end of the cylinder chamber 18. The housing 32 includes a round opening 34 whose interior diameter is only slightly greater than the exterior diameter of the main body of the ram 22. Thus, the inner surface of the opening 34 constitutes the top bearing for the ram 22. The housing 32 includes a recess 36 in the bore 34 to accomodate a seal 38.

The lower end of the ram 22 is provided with a seal 40 which bears against the interior walls of the cylinder chamber 18. The seal 40 is held in in place the bottom of the ram by a nut 42 which is threaded on a stem protrusion 44 at the center of the ram 22. The nut 42 bears against a washer 46 which, in turn, bears against the seal 40.

The center of the ram 22 has a hollow bore 48 extending along its long axis, that is, the axis on which the ram 22 moves when it extends out of the cylinder chamber 18. A pump shaft 50 is slideably fitted in the bore 48 so that one end of the shaft 50 extends out of the ram 22. The end of the shaft 50 which is contained within the bore 48 has a seal which bears against the walls of the bore 48. The bore 48 is constricted at its lower end to have a reduced diameter portion 54. The bore then expands in diameter to approximately its original size and exits from the stem 44 at the bottom of the ram.

A fluid inlet passage 56 provides fluid communication between the pump bore 48 at the reduced diameter portion 54 and the exterior surface of the ram at a point situated above the ram 22 is less than the interior diameter of the cylinder chamber 18 so that an annular fluid chamber 60 exists between the ram and cylinder chamber and between the bearing surface 30 and the seal and bearing housing 32. A spring loaded ball check valve 58 is mounted in the passage 56 to prevent fluid from flowing out of the pump bore 48 into the annular chamber 60. A second spring loaded check valve 62 is mounted in the bore 48 below the constricted portion 54, as viewed in FIG. 2, and is held in place by a retaining washer 64 mounted at the bottom end of the stem 44 of the ram 22. The valve 62 seats on the constriction 54. The check valve 62 prevents fluid trapped between the bottom of the ram 22 and the closed end 26 of the cylinder chamber from passing back into the pump bore 48.

The annular chamber 60 is connected through a fluid passage 66 in both the wall of the cylinder chamber 18 and the seal and bearing housing 32 with a collapsible reservoir 68 of hydraulic fluid contained within a hollow handle 70. The handle 70 is threaded onto an extension 72 of the seal and bearing housing 32. A tension spring 74 tends to keep the reservoir 68 in a slightly collapsed configuration so as to exert a very slight positive pressure on the hydraulic fluid within the reservoir. This helps to prevent air from leaking into the hydraulic system through any of the various seals. Such air would otherwise cause sudsing which would interfere with the hydraulic operation of the tool.

It will thus be appreciated that reciprocation of the pump shaft 50 in the pump bore 48 will cause hydraulic fluid to be sucked from the reservoir 68 through the fluid passage 66, the annular space 60 and through the inlet passage 56 into the pump bore 48. On the downward stroke the pump plunger shaft 50 forces fluid through the check valve 62 into the space between the bottom of the ram 22 and the closed end 26 of the cylinder chamber 18. As can be more clearly seen in FIG. 1, this has the result of spreading apart the yoke members 20 and 24 which are attached to the cutting elements 14 and 12, respectively, so as to close them together.

In order to relieve the hydraulic pressure within the cylinder chamber 18, the ram 22 is provided with a straight bore 76 paralleling the bore 48 and exiting at the top and bottom surfaces of the ram 22. The bore 76 includes a restricted diameter portion 78 near its lower end against which a ball valve 80 seats. A push rod 82 is loosely fitted into the bore 76 and is forced downwardly by a plug 84 threaded the top portion of the bore 76. When the plug 84 is threaded into its fullest extent, the push rod 82 holds the ball 80 against the restricted portion 78 of the bore 76 thereby preventing fluid from escaping from the shaft 78, when the plug 84 is unthreaded, the push rod 82 allows the ball valve to become unseated. A cross bore 86 provides fluid communication between the portion of the shaft 76 above the ball valve 80 and the annular space 60. This allows the fluid passing through the ball valve 80 to return to the fluid reservoir 68.

The pump plunger shaft 50 is reciprocated in the pump bore 48 by means of a handle 88 which is connected at one end to the top of the ram 22 by a pivot link 90. The handle 88 is also pivotally connected to the top of the shaft 50 at a point closely adjacent to the end which is connected to the pivot link 90. The handles 88 and 70 are gripped by the user of the tool when operating it and are repeatedly squeezed together so that the pump shaft 50 is moved up and down in the pump bore 48, causing hydraulic fluid pressure to build up between the cylinder chamber closed end 26 and the bottom of the ram 22, as described above.

From FIGS. 1 and 2 it can be seen that nearly all of the axial forces produced in the hydraulic system of the invention are aligned with each other and are effectively balanced. For example, the force exerted by the operator when pumping the system lies in the same plane of movement as the cutting jaws 12 and 14, thus there is no tendency to misalign the jaws on the work piece.

In some prior art systems the pumping had to be done from a plane which is relatively perpendicular to the plane in which the jaws moved, i.e., from the sides, thus having the tendency to cause them to slip on the work piece. While the hydraulic system of the invention has been described with reference to FIGS. 1 and 2 particularly for use with cutting elements, it should be apparent that it can also be used with other types of tools elements as will be described in greater detail hereinafter with reference to FIGS. 6, 7 and 8.

Figure 3:
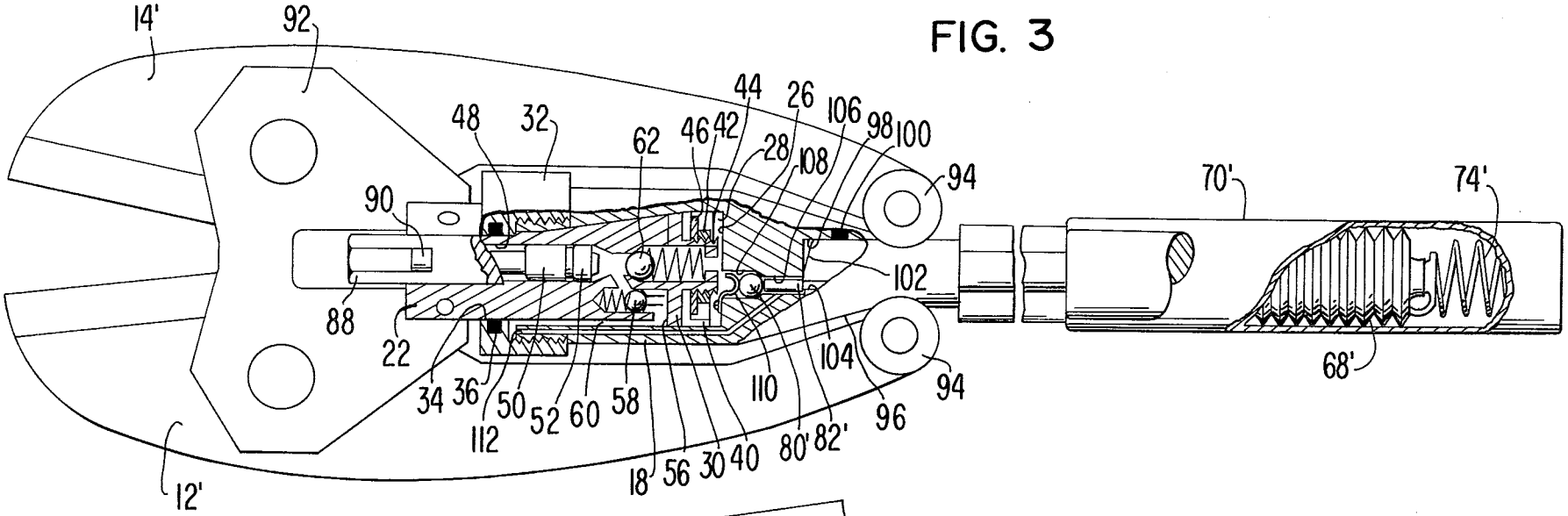
FIG. 3 is a top view, partly in section and with portions broken away, of a cutting tool according to a second embodiment of the invention.
Figure 4:
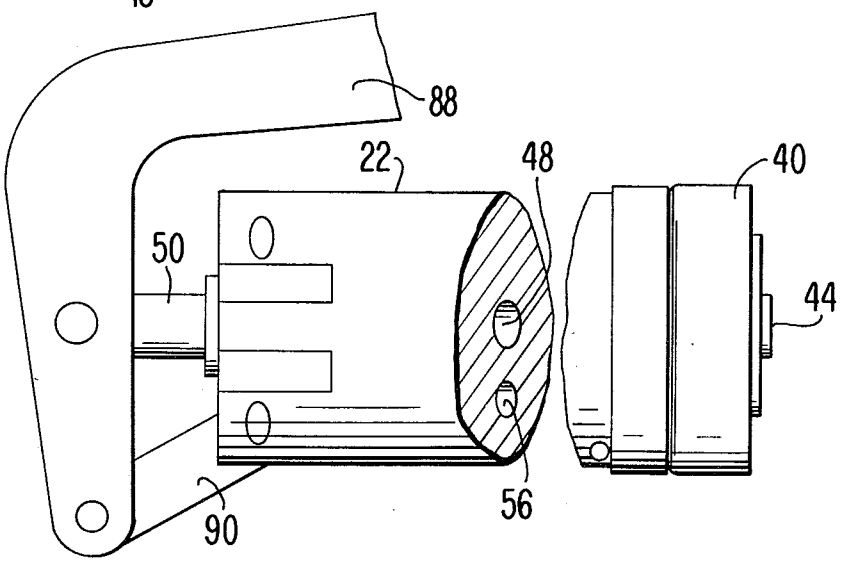
FIG. 4 is a side view, with portions broken away and in section, of the ram and pumping elements of the embodiment depicted in FIG. 3.

Referring more particularly to FIGS. 3 and 4, a slightly different type of manual, hydraulically-operated cutting tool according to the invention is illustrated. The hydraulic system of the embodiment of FIGS. 3 and 4 is substantially the same as the hydraulic system described above with reference to FIGS. 1 and 2, and therefore the same reference numerals for the same elements have been used. The primary difference between this embodiment and the embodiment described with reference to FIGS. 1 and 2 lies in the method in which the expanding forces of the hydraulic system is transmitted to the cutting elements.

In the embodiment depicted in FIGS. 3 and 4 a pair of elongated cutting elements 12' and 14'are pivoted intermediate their ends in a pair of spaced apart triangularly shaped yoke member 92. Although only one member 92 is shown in the figure, it will be appreciated that a corresponding yoke member lies on the opposite side of blades 12' and 14' and 14'as viewed in FIG. 3 so that the blades are pivoted between the two yoke members 92. The ends of the cutting blades 12' which are opposite the cutting edges are each provided with a roller 94 which has a concave rolling surface.

The yoke members 92 are pinned to the top of the ram 22 so as to move with it. The exterior surface of the cylinder chamber 18 near the bottom closed end 26 has a conical or wedge shaped exterior configuration 96 on which the rollers 94 are positioned to ride. Thus when the ram 22 and the cylinder chamber 18 are caused to extend with respect to each other, the rollers 94 will be pushed apart from each other by riding up the wedge shaped surface 96, causing the cutting edges of the cutting elements 12' and 14' to close. Thus not only is a hydraulic advantage obtained but additionally a mechanical advantage is obtained as well by use of the wedge configuration.

The hydraulic operating system of the tool depicted in FIGS. 3 and 4 is substantially the same as the system described above in reference to FIGS. 1 and 2. A collapsible, accordian type reservoir 68' is carried in the handle 70' which is attached to the cylinder chamber 18. A compression spring 74' in the hollow handle 70' pushes against the reservoir 68' to exert a slight positive pressure on the hydraulic fluid contained within the system so as to help prevent air leaks.

In contrast to the tool described in reference to FIGS. 1 and 2, the handle 70' of this tool is in a straight line with the direction of the ram movement. The handle 70' is contained in a bore 98 at the base of the wedge shaped portion 96 of the cylinder chamber 18. A seal 100 surrounds the inserted end portion of the handle 90' to prevent leakage. The handle is retained in the bore 98 by a restraining clip or the like which is not shown. The contained end of the handle 70' is beveled at one corner, and this beveled portion is designated by the reference numeral 102. A passage 104 in the handle 70' provides fluid communication between the reservoir 68' and a corresponding fluid passage 106 in the wedge shaped portion 96 of the cylinder chamber 18.

The passage 106 has an enlarged diameter portion 108 which connects with the "closed" end of the cylinder chamber 18. The check ball valve 80' is contained within this enlarged diameter portion 108 of the bore 106 and seats against the shoulder formed at the point where the diameter of the bore is reduced. A spring 110 maintains the ball valve 80' normally closed against the passage of fluid out of the cylinder chamber 18. A fluid inlet passage 112 in the wall of the cylinder chamber 18 provides fluid communication between the bore 106 and the annular space 60 between the ram 22 and the interior of the cylinder chamber 18.

The ball valve 80' is unseated, so as to become open, by the action of the push rod 82' situated in the bore 106. The rod 82' is of a smaller diameter than the interior diameter of the bore 106, thereby allowing fluid to pass freely through the bore 106. As shown in FIG. 3 the push rod 82' bears at one end against the contained end of the handle 70'. Thus in the position of the handle as shown in FIG. 3, the system is opened, thereby allowing fluid trapped between the end of the ram 22 and the cylinder chamber closed end 26 to return to the reservoir 68'. When the handle 70' is rotated approximately 180° from the position shown in FIG. 3, the beveled portion 102 lies opposite to the push rod 82'. This allows the push rod 82' to slide outwardly in the bore 106 so that the ball valve 80' seats and closes off the passage 106 to returning fluid from the cylinder chamber 18.

With the system closed, pulling the pumping plunger 50 outwardly in its bore 48 within the ram 22 causes fluid from the hydraulic reservoir 68' to be drawn through the fluid passages 104 and 106, to unseat the ball valve 80' in the intake direction and to pass through the fluid passage 112 into the annular chamber 60. From this point on the hydraulic system operates in substantially the same manner as described above with reference to FIGS. 1 and 2, that is, continued pumping of the plunger 50 causes hydraulic fluid pressure to build up between the closed end of the cylinder chamber 18 and the bottom of the ram 22. The resulting relative movement between the ram 22 and the cylinder chamber 18 causes the wedge shaped portion 96 to be shoved between the rollers 94, thereby causing the cutting blades 14' and 12' to close. As mentioned above, rotating the handle 70' to the position where the push rod 82' unseats the valve 80' allows the system to be returned to its original configuration and the fluid to be retransmitted to the reservoir 68'.

Figure 5:
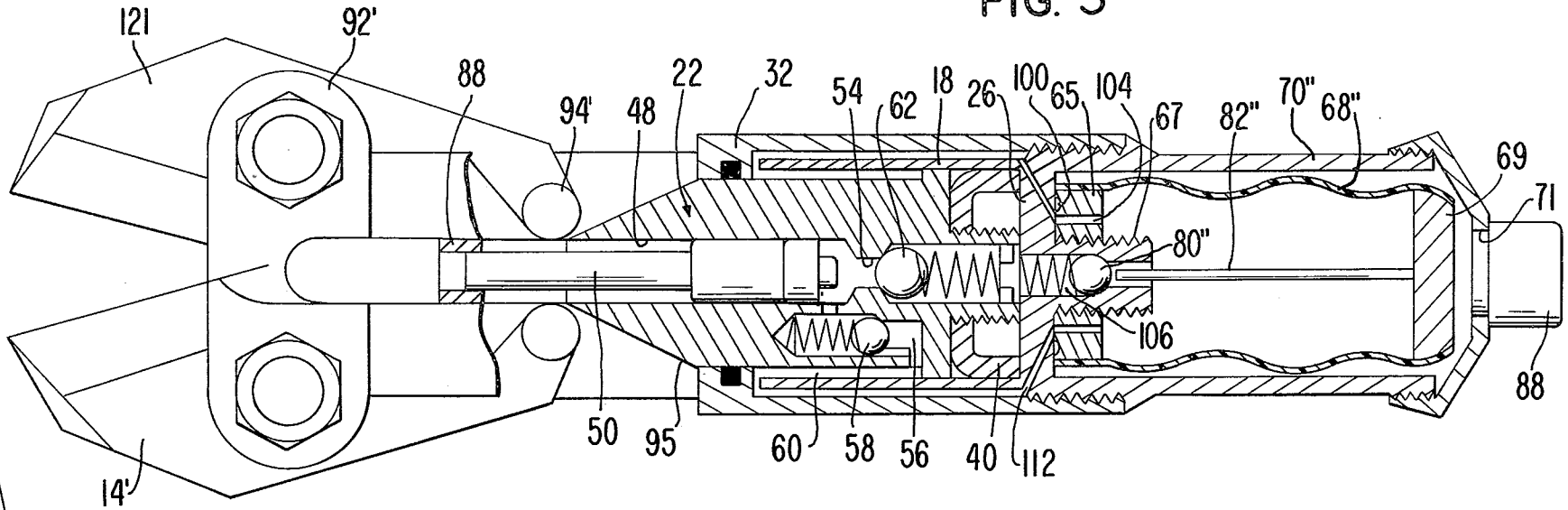
FIG. 5 is a top view, partly in section and with portions broken away, of a cutting tool according to a third embodiment of the invention.

With reference now more particularly to FIG. 5, a modification of the embodiment depicted in FIGS. 3 and 4 is illustrated using essentially the same hydraulic system but instead of having a wedge shaped configuration to the exterior of the cylinder chamber 18, the ram is provided with a wedge shaped contour 95 so as to drive apart the rollers mounted on the ends of the cutting elements 12' and 14'. The handle 70' and the cylinder chamber 18 are integrally formed as one unit. The seal and bearing housing 32 is extended to be threaded onto the cylinder chamber 18 at its base. The reservoir 68'' has a threaded plug 65 at one end which has a central threaded opening. This opening threads onto a stub 67 which projects from the chamber's closed end 26 on the side opposite to the ram 22. This stub 67 contains the relief bore 106 in which the check valve 80'' seats. The push rod 82'' for opening the check valve 80'' to return the hydraulic fluid to the reservoir 68'' is contained within the reservoir and projects from a solid button 69 which closes off one end of reservoir. An opening 71 in the base of the handle 70'' allows the operator, by pushing in on the button 69, to relieve the hydraulic pressure acting on the ram 22.

Figure 6:
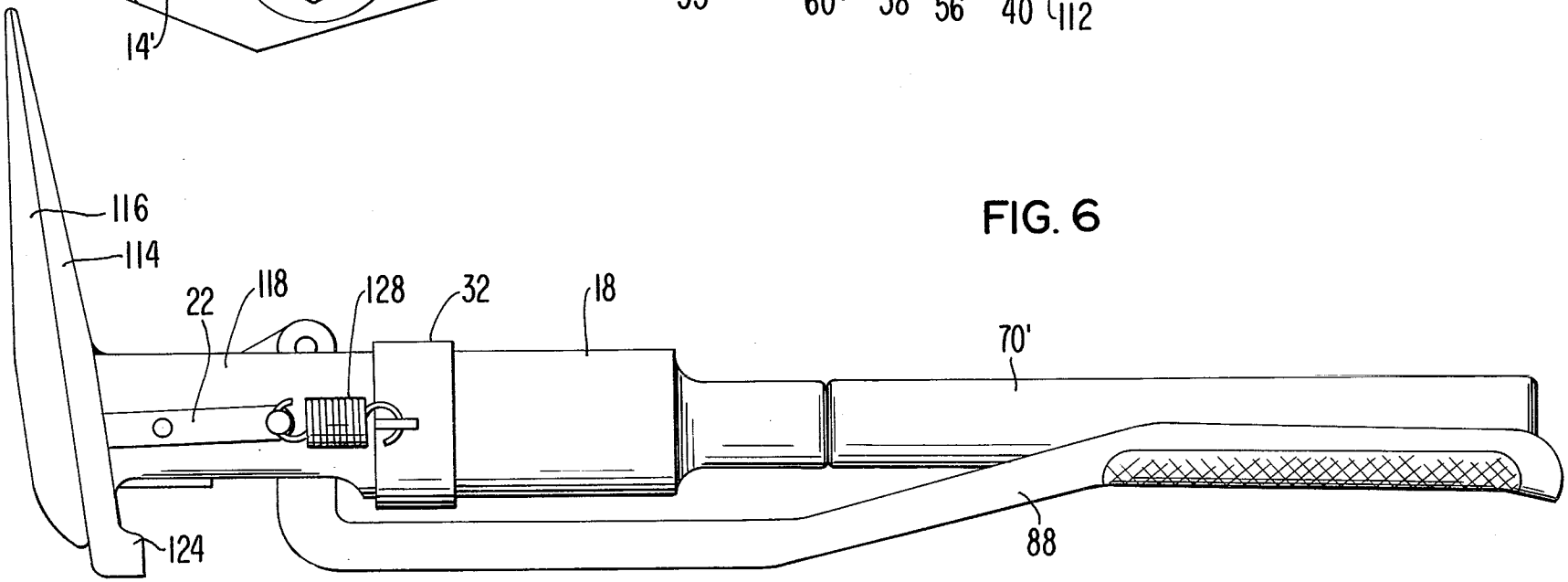
FIg. 6 is a top view of a manual, hydraulically operated expander tool according to a fourth embodiment of the invention.
Figure 7:
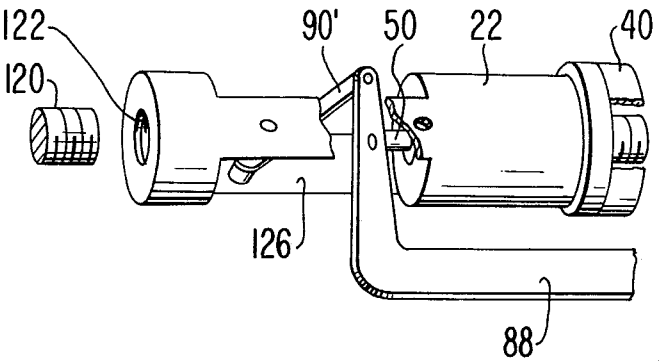
FIG. 7 is a perspective view, with portions broken away and in section, of the ram unit of the embodiment depicted in FIG. 6 together with a portion of the working elements.

Referring now more particularly to FIGS. 6 and 7, still another embodiment of the invention is illustrated in the form of a manual, hydraulically operated spreading tool of the type which is used to disengage concrete forms from the cast structure. For example, the hydraulic system is substantially the same as that described above with reference to FIGS. 3 and 4. The reservoir is contained within the handle 70' and rotation of the handle allows fluid to be either pumping into the cylinder chamber 18 or to be returned to the reservoir contained within the handle 70'. Instead of cutting elements, however, a pair of wedge shaped prongs 114 and 116 are operated by the hydraulic system. The prong 114 is mounted at a slight angle on a boss 118. Boss 118 is rigidly attached to the seal and bearing housing 32 mounted at one end of the cylinder chamber 18. The boss 118 is either yoke shaped or hollow to accommodate the movement of the ram 22 out of the cylinder chamber 18.

The wedge shaped member 116 has a projecting stub 120 which is threaded into a corresponding hole 122 at the outward end of the ram 22. It will thus be appreciated that moving the handles 70' and 88 back and forth with respect to each other will pump the system so as to cause the ram 22 to extend out of the cylinder chamber 18. This has the effect of spreading apart the wedge shaped members 114 and 116. The members 114 and 116 taper to a point at one end and the opposite end of the member 114 is provided with a reinforced portion 124 suitable for pounding the members 114 and 116 into the space between the form and the concrete structure.

In contrast to the previously described tools where the pumping handle 88 is pivoted to the top of the ram 22 by the connecting link 90, in the embodiment depicted in FIGS. 6 and 7 the portion of the handle 88 which is pivoted to the pump plunger shaft 50 is fitted within a slot 126 extending through the ram 22. The connecting link 90' is pivoted to the ram 22 above the handle 88 rather than below it as in the other embodiments. A tension spring 128 is pinned between the ram 22 and the seal and bearing housing 32 to cause the ram to be drawn back into the cylinder chamber 18 when the handle 70' is rotated to allow the fluid to be drawn back into the reservoir. A similar device could also be mounted on the other tools described above.

It should be apparent that the expander tool shown in FIGS. 6 and 7 could also be used as an emergency device to extricate accident victims from automobiles having jammed doors, for example.

Figure 8:
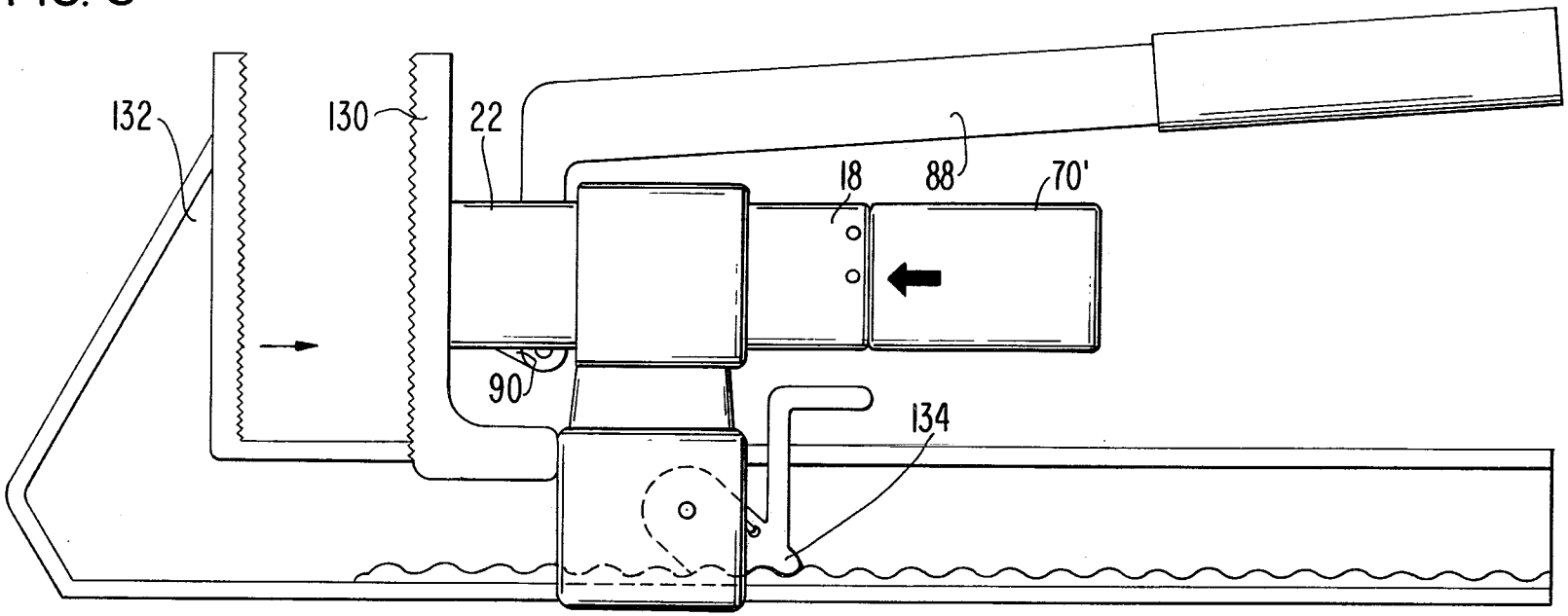
FIG. 8 is a top view of a manual, hydraulically operated clamp according to a fifth embodiment of the invention.

Referring now more particularly to FIG. 8, a modification of the embodiment depicted in FIGS. 6 and 7 is illustrated wherein, instead of spreading apart two working elements, a pair of working elements 130 and 132 are drawn together by the action of the hydraulic system so as to form clamping members. A ratchet mechanism 134 connected to the element 132 allows the elements 130 and 132 to be positioned snug on the work piece before the hydraulic system is operated by moving the handles 70' and 88 back and forth to firmly clamp the members 130 and 132 together.

While in the above-described embodiments certain utilizations of the hydraulic system of the invention have been set forth, it should be apparent that the hydraulic system of the invention has numeroous other applications for manual, hydraulically operated tools. Furthermore, although the foregoing invention has been described in some detail by way of illustration and example for purposes of clarity of understanding, it is understood that certain changes and modifications may be practiced within the spirit of the invention as limited only by the scope of the appended claims.

I claim:

1. An improved hydraulically operated tool of the type having a cylinder chamber closed at one end, a hydraulic ram within the cylinder chamber, a fluid reservoir, hydraulic pumping means fed by the reservoir for driving the ram out of the cylinder chamber, and work engaging elements operatively connected to the ram and cylinder chamber, wherein the improvement comprises mounting the pumping means in part within the ram, the pumping means including a fluid filled pump chamber within the ram, check valve means mounted in the ram, and wherein the tool further includes means for providing fluid communication between the reservoir and the check valve means and the pumping means further includes means mounted on the ram for pumping fluid from the reservoir through the fluid communication means and the check valve means into the cylinder chamber at the closed end to force the ram to move out of the cylinder chamber thereby operating the work engaging elements.

2. An improved hydraulically operated tool as recited in claim 1 wherein the ram is provided with fluid inlet and outlet passages and the pumping means causes fluid to be injected into the cylinder chamber at the closed end through the ram inlet passage.

3. A hydraulically operated tool as recited in claim 1 wherein the pumping means, ram and cylinder chamber are coaxial.

4. An improved hydraulically-operated tool of the type having a cylinder chamber closed at one end, a hydraulic ram within the cylinder chamber, a fluid reservoir, hydraulic pumping means fed by the reservoir for driving the ram out of the cylinder chamber, ad work engaging elements operatively connected to the ram and cylinder chamber, wherein the improvement comprises mounting the pumping means within the ram, the pumping means including a pump chamber within the ram, the chamber having its major axis extending parallel to the direction of movement of the ram, a plugner fitted within the chamber, check valve means mounted in the ram, and wherein the tool further includes means for providing fluid communication between the reservoir and the check valve means and means mounted on the ram for operating the plunger in the pump chamber to pump fluid from the reservoir through the fulid communication means and the check valve means into the cylinder chamber at the closed end to force the ram to move out of the cylinder chamber thereby operating the work engaging elements.

5. A hydraulically operated tool as recited in claim 4 wherein the plunger operating means comprise a first handle pivoted to the plunger and pivot linkage means for connecting the first handle at one end to the ram, and wherein the tool further includes a second handle rigidly attached at one end to the cylinder chamber, the second handle being hollow and containing the fluid reservoir, and wherein the reservoir is at least partially collapsible upon the withdrawal of fluid from it by the pumping means.

6. An improved hydraulically operated tool as recited in claim 1 wherein the work engaging elements comprise a pair of elongated jaws and further including means for pivotably mounting each of the elongated jaws intermediate their opposite ends and opposed to each other and wedge means operated by the action of the ram moving out of the cylinder chamber for spreading apart corresponding ends of the elongated jaws to close the opposite ends of the elongated jaws together.

7. An improved hydraulically operated tool as recited in claim 1 wherein the work engaging elements comprise a pair of elongated gripping members connected between the cylinder chamber and the ram so as to be drawn in a clamping action as the ram is expanded out of the cylinder chamber by action of the pumping means.

8. An improved hydraulically operated tool as recited in claim 1 wherein the work engaging elements comprise a pair of cutting jaws.

9. An improved hydraulically operated tool as recited in claim 1 wherein the work engaging elements comprise a pair of wedge shaped members connected between the cylinder chamber and the ram so as to be spread apart as the ram is expanded out of the cylinder chamber by action of the pumping means.

10. An improved hydraulically operated tool as recited in claim 1 wherein the work engaging elements are operated by the engaging force of either the ram or the cylinder chamber upon actuation of the pumping means and further including a handle-lever for operating the pumping means, the handle-lever being pivotally mounted on the ram.

11. An improved hydraulically operated tool as recited in claim 4 wherein the work engaging elements comprise a pair of elongated jaws and further including means for pivotably mounting each of the elongated jaws intermediate their opposite ends and opposed to each other and wedge means operated by the action of the ram moving out of the cylinder chamber for spreading apart corresponding ends of the elongated jaws to close the opposite ends of the elongated jaws together.

12. An improved hydraulically operated tool as recited in claim 4 wherein the work engaging elements comprise a pair of elongated gripping members connected between the cylinder chamber and the ram so as to be drawn in a clamping action as the ram is expanded out of the cylinder chamber by action of the pumping means.

13. An improved hydraulically operated tool as recited in claim 4 wherein the work engaging elements comprise a pair of cutting jaws.

14. An improved hydraulically operated tool as recited in claim 4 wherein the work engaging elements comprise a pair of wedge shaped members connected between the cylinder chamber and the ram so as to be spread apart as the ram is expanded out of the cylinder chamber by action of the pumping means.

15. An improved hydraulically operated tool as recited in claim 4 wherein the ram and pumping means are concentrically contained within the cylinder chamber and wherein the work engaging elements are operated by the engaging force of either the ram or the cylinder chamber upon actuation of the pumping means.

16. An improved hydraulically operated tool as recited in claim 4 wherein the check valve means comprise an inlet check valve interposed between the fluid communication means from the reservoir and the pump chamber within the ram to prevent fluid from flowing out of the pump chamber and back to the fluid communication means, and an outlet check valve mounted at the bottom of the pump chamber between the plunger and the closed end of the cylinder chamber to prevent fluid pumped by the plunger from re-entering the pump chamber.

17. An improved hydraulically operated tool as recited in claim 4 wherein the improvement further comprises an exhaust valve within the closed end of the cylinder chamber for exhausting fluid within the cylinder chamber back to the reservoir when the exhaust valve is opened, and manually operable push rod means within the reservoir for opening the exhaust valve.

18. An improved hydraulically operated tool as recited in claim 1 wherein the check valve means comprise an inlet check valve interposed between the fluid communication means from the reservoir and the pump chamber within the ram to prevent fluid from flowing out of the pump chamber back to the fluid communication means, and an outlet check valve mounted at the bottom of the pump chamber between the plunger and the closed end of the cylinder chamber to prevent fluid pumped by the plunger from re-entering the pump chamber.

19. An improved hydraulically operated tool as recited in claim 1 wherein the improvement further comprises an exhaust valve within the closed end of the cylinder chamber for exhausting fluid within the cylinder chamber back to the reservoir when the exhaust valve is opened, and manually operable push rod means within the reservoir for opening the exhaust valve.

* * * * *